US005461799A

United States Patent [19]

Kim

[11] Patent Number: 5,461,799

[45] Date of Patent: Oct. 31, 1995

[54] FRONTAL SOLE EXERCISE DEVICE

[75] Inventor: John Y. Kim, Palo Alto, Calif.

[73] Assignee: Metapro, Mountain View, Calif.

[21] Appl. No.: 115,169

[22] Filed: Aug. 30, 1993

Related U.S. Application Data

[63] Continuation-in-part of Ser. No. 65,314, May 20, 1993, Pat. No. 5,339,542.

[51] Int. Cl.[6] ..... A43B 3/18

[52] U.S. Cl. ..... 36/7.2; 36/7.5; 36/132

[58] Field of Search ..... 36/7.1 R, 7.2, 36/7.4, 7.7, 7.5, 7.6, 7.8, 11.5, 23, 25 R, 50.1, 54, 81, 88, 89, 90, 106, 112–114, 132, 140, 77 R, 1

[56] References Cited

U.S. PATENT DOCUMENTS

| | | | |
|---|---|---|---|
| 1,237,452 | 8/1917 | Baldwin | 36/7.7 |
| 1,567,714 | 12/1925 | Dessan | 36/7.4 |
| 1,568,616 | 1/1926 | Parr | 36/7.6 |
| 1,640,302 | 8/1927 | Van Tassell | 36/7.8 |
| 2,268,435 | 12/1941 | Zucker | 36/7.5 |
| 2,513,005 | 6/1950 | Crawford | 36/11.5 |
| 3,889,400 | 6/1975 | Atzinger | 36/7.5 |
| 4,271,605 | 6/1981 | Raczka | 36/7.2 |
| 5,339,542 | 8/1994 | Kim | 36/7.2 |

FOREIGN PATENT DOCUMENTS

| | | | |
|---|---|---|---|
| 205146 | 8/1939 | Switzerland | 36/7.2 |
| 5188 | of 1891 | United Kingdom | 36/7.6 |

*Primary Examiner*—Paul T. Sewell
*Assistant Examiner*—Thomas P. Hilliard
*Attorney, Agent, or Firm*—LaRiviere, Grubman & Payne

[57] ABSTRACT

An exercise device for strengthening the muscles and ligaments of the feet, legs and lower torso. The device comprises a platform element, front and rear securing straps, a footbed and a tractive sole. The rear securing straps are attached substantially below the upper level of the platform element, helping to preclude inadvertent egress from the device while in use. The front securing straps are for substantially securing the forward portion of the foot to the device. In a preferred embodiment, the exercise device comprises a longitudinal upper strap, a radial lower strap and a mid strap for maintaining the foot securely in the exercise device.

6 Claims, 6 Drawing Sheets

FRONTAL SOLE EXERCISE DEVICE

This is a continuation-in-part of application Ser. No. 08/065,314, filed May 20, 1993, now U.S. Pat. No. 5,339, 542.

TECHNICAL FIELD

This invention relates to exercise equipment, in particular a frontal sole exercise device. The device is removably attachable to a human foot and a wide variety of footwear. The device may be used for conditioning and strengthening muscles and ligaments of the wearer's feet, legs and lower torso.

BACKGROUND

To strengthen the muscles and ligaments of the lower body, it is known in physical education to perform exercises directed to hopping, running, jumping, lifting weights, etc. on the balls of the person's feet. In so doing, a person will strengthen many of the major muscle groups of the feet, legs and lower torso. The efficacy of these exercises is directly related to the amount of weight borne on the forward part of the foot of the user, and also directly related to the number of repetitions of each exercise so performed.

U.S. Pat. No. 3,739,500 to Cox describes a shoe, and the use thereof, with a platform integrally attached to the front of the shoe. In Cox, an exercise shoe having attached thereto a flexible pillar sole member for causing the wearer to stand, walk and run on the balls of the feet, thereby maximizing the effect and potential benefit of any repetitions performed. The benefits of training on elevated front foot shoes are well described in Cox. Many athletes prefer to obtain such benefits wearing their normal training shoes.

Cox alludes to the possibility of attaching his extension separately to conventional athletic shoes: ". . . the extension with its ground contacting sole may be separately manufactured and suitably attached to conventional athletic shoes." (column 2, lines 52–54) The challenge heretofore has been to attach platforms removably to the wearer's normal training shoes, such that they remain securely attached during rigorous running and jumping, yet are removable after use. The absence, so far, of a commercially successful separate shoe extension stems from the fact that a satisfactory design has proved elusive. If the platforms were to be attached securely enough, they had to be attached to the shoe with some degree of permanence, such as being glued onto the bottoms, or being bolted through holes drilled into the sole; If the platforms were to be attached removably enough, they were somehow strapped onto or tied to the shoe making them prone to shifting or slipping off during the course of vigorous exercise. The present invention offers a novel solution providing the functions of both secure attachment and easy removability.

The exercise shoe of Cox has several limitations: (1) it is an expensive piece of equipment, consisting of an entire shoe; (2) it is a size specific piece of equipment, a pair only usable by individuals having the same shoe size; (3) it is a complete shoe, the user of which cannot use the athletic shoe which he uses in competition while using the exercise shoe (this is to many athletes a significant problem in that to maximize their performance they prefer to train in the same shoes in which they compete); (4) it is a shoe which prevents training in one's bare feet (many athletes, particularly sprinters and distance runners prefer to exercise and compete in their bare feet); and (5) it is a bulky piece of equipment, requiting significant space allotment.

DISCLOSURE OF INVENTION

According to the present invention, a device for exercising the feet, legs and lower torso is disclosed. The frontal sole exercise device of the present invention employs easily removable means of attachment of the device to a variety of footwear, and may be used without any footwear. Securing the feet or footwear to the device of the present invention is by means of two sets of securing straps: one set securing the front portion of the feet ("toe straps") and one set securing the rear portion of the feet ("mid straps"). These two sets of straps in combination prevent any unwanted motion by the foot or footwear while using the device, The straps are adjusted and fastened by fastening means in operative combination with each of the several straps.

The platform element of the present invention is a firm, resilient material, which is resistant to compression while providing sufficient capability to absorb the shock created during use. The bottom surface of the platform element of the present invention is covered with a tractive sole to firmly grip the ground or other surface used during exercise. By attaching the rear securing strap to the bottom portion of the platform element, the tendency of the user's foot to lift away from the device while in use is reduced. The platform device has on its upper surface a footbed to receive the user's foot. By combining this footbed with the previously discussed securing straps, the device is usable by several users having a variety of different sized feet. Also, the exercise device of the present invention may be made of various colors and styles, e.g., neon colors and prints.

One feature of the present invention is the reverse angle of the rear edge of the platform element. Another feature is the thickness of the platform element. These features serve to ensure that substantially all the user's weight is borne upon the forward part of the foot.

In a preferred embodiment of the present invention, a longitudinal upper strap, a radial lower strap and a mid strap are used in combination with anchor strap means. This preferred embodiment provides limitation of foot movement while using the exercise device of the present invention.

Because the exercise device of the present invention is not built around an integral shoe, it is easier and less expensive to manufacture than the shoe of Cox. A further benefit of this configuration is that the exercise device of the present invention in therefore smaller than the shoe of Cox. Also, the present invention can be removably attached to a variety of footwear.

The exercise device of the present invention can improve the development of fast-twitch muscle fiber. The muscle fiber associated with actions requiring maximum effort of a short duration, such as sprinting and jumping.

To summarize, the benefits of training on elevated front foot shoes are well described by Cox. By approaching the same benefits in a different manner the present invention improves upon Cox in several important areas:

a. the present invention platforms are cheaper to build than an actual shoe with a molded-in sole platform, and thus can be sold at a more affordable cost to the consumer;

b. the present invention platforms will function when attached to any style shoe, e.g., running, court, crosstraining, aerobic, hightop, midtop or lowtop;

c. one pair of present invention platforms can be attached to accommodate shoes with minor size differences (plus/minus one whole size increment with the preferred embodiment), a shoe with integrally molded platforms, however, is inherently size specific, thereby offering no interchangeability for players on a team, different members of a family on a limited budget or youths with growing feet; and d. the present invention platforms are more compact to carry and store than platform molded shoes.

Other features of the present invention are disclosed or apparent in the section entitled "Best Mode For Carrying Out the Invention".

BRIEF DESCRIPTION OF DRAWINGS

For fuller understanding of the present invention, reference is made to the accompanying drawing in the following detailed description of the Best Mode for Carrying Out The Invention.

Figure 1:
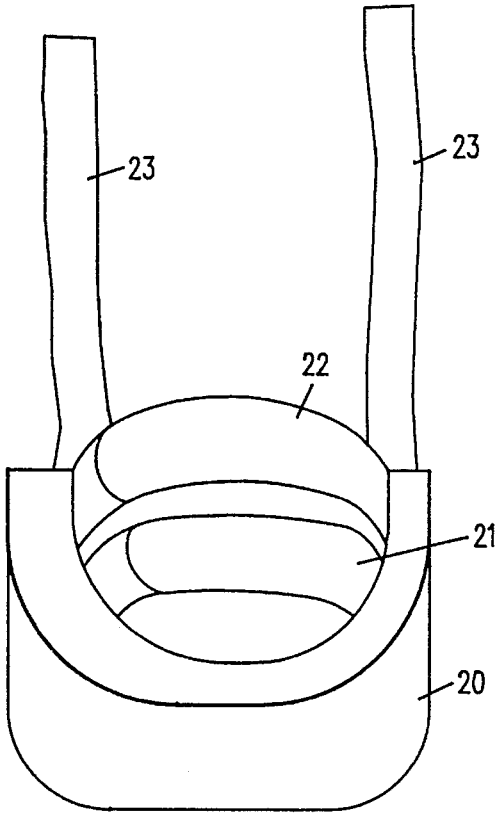
FIG. 1 is a from perspective view of the exercise device of the present invention, showing rear securing straps raised in the air.

Reference numbers refer to the same or equivalent parts of the present invention throughout the several figures of the drawing.

BEST MODE OF CARRYING OUT THE INVENTION

Referring to FIG. 1, a frontal sole exercise device comprises a platform element 20 having front securing straps 21, 22, and rear securing straps 23. The exercise device of the present invention may be removably attached to an item of footwear, to a naked human foot, or to a foot wearing an item of footwear, for instance an athletic shoe, a sock or both. While preferred use includes wearing a hightop athletic shoe, the present invention may be practiced with any style shoe, e.g., running, court, crosstraining, aerobic, midtop or lowtop.

Platform element 20 is centered substantially below the natural flex point of the foot coinciding with the ball of the foot, and causing substantially all the user's weight to be borne on the forward part of the foot, e.g., the distal portions of the metatarsals and those pedal structures distal thereto while the device is in use. With preferred use, none of the user's weight is borne upon the heel. This can also improve the mechanics of going off the toe and not the heel.

Platform element 20 in a preferred embodiment possesses sufficient thickness, resiliency and resistance to compression to substantially preclude contact between the heel area of the foot or of the footwear and the ground. A thickness of approximately two inches is sufficient for this purpose without causing the user to be so high as to create imbalance. In the preferred embodiment of the present invention, platform element 20 is composed of a monolithic block of resilient foam, for example polyethylene (manufactured under the trade name ethafoam). Alternative embodiments of platform element 20 of the present invention may be made of rubber, polyurethane, polyvinyl chloride, ethylene vinyl acetate (EVA), or any of several resilient compounds or substances well known to those skilled in the art. As an alternative to monolithic construction, platform element 20 may be fabricated with an internally hollow honeycomb core thereby maintaining rigidity and resistance to compression while reducing mass. However, the extra mass provided by the present invention at the from of the foot is useful for developing calf muscles.

Figure 11:
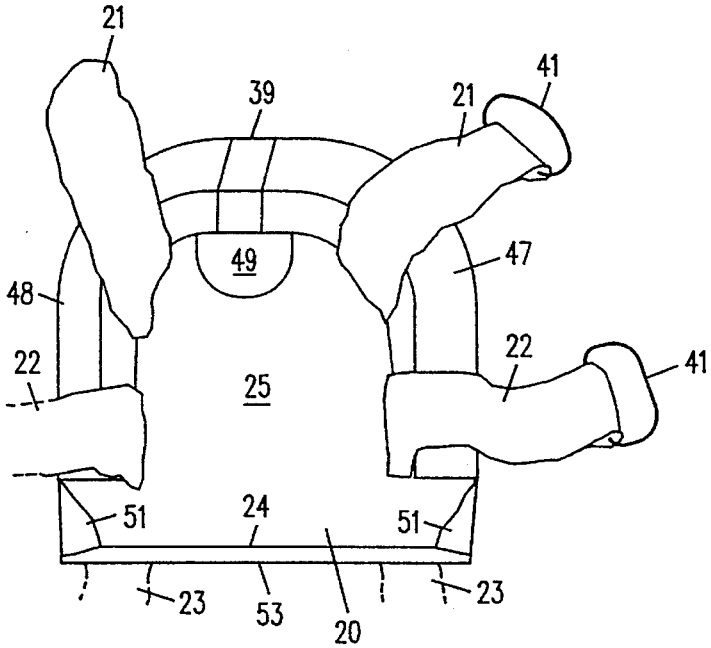

As indicated hereinabove, platform element 20 has affixed thereto means for securing a substantially forward portion of the foot to platform element 20. Securing may be accomplished through use of mechanical fasteners, laces, ties, or one or more straps. In an embodiment of the present invention, front securing straps 21, 22 perform this function, thereby limiting the forward; lateral and horizontal torsional movements of the foot within the footbed, and further limiting inadvertent forward or upward egress of the foot from the exercise device while in use. In one embodiment, front securing straps 21, 22 comprise a hook and loop type material, and may further be provided with D-zings 41 (as shown in FIG. 11). Front securing straps 21, 22 may be attached through openings created in platform element 20.

As previously indicated, platform element 20 likewise has affixed thereto securing means for securing a substantially rearward portion of the foot to platform element 20. In an embodiment of the present invention, substantially securing the rearward portion of the foot is accomplished with rear securing straps 23. Rear securing straps 23 are operable with front securing straps 21, 22 to further limit horizontal torsional movement of the footwear, while preventing inadvertent rearward egress of the foot from the exercise sole.

Figure 2:
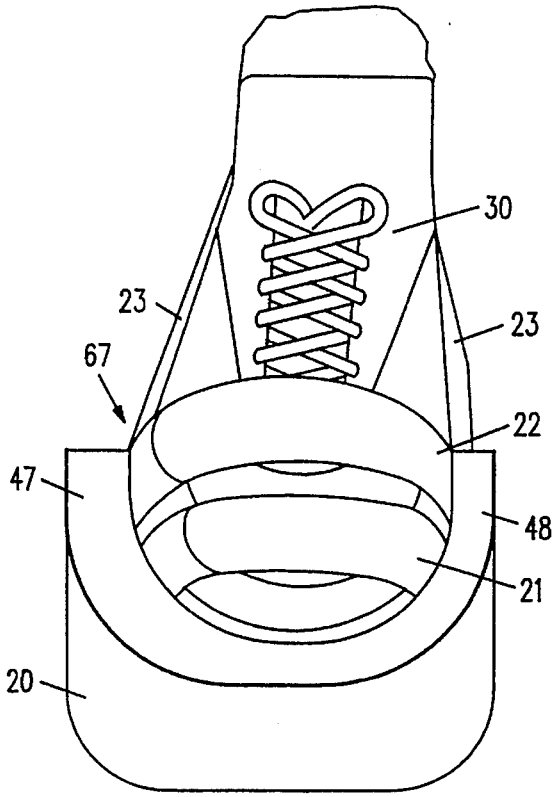
FIG. 2 is a front perspective view of the exercise device of FIG. 1 showing a shoe fastened therein.

Referring now to FIG. 2, there is shown an athletic shoe 30 fastened to the frontal sole exercise device of the present invention. It will be seen that front securing straps 21, 22 hold athletic shoe 30 securely in the platform element 20, while rear securing straps 23 wrap around the heel and cross over one another and fasten in front around the ankle.

Straps 23 cross about portions of the fight and left quarters of shoe 30. The term quarter refers to that part of shoe 30 from the middle of the back ("counter region") to the vamp. The vamp is the upper portion of the shoe covering the instep and toes.

Figure 3:
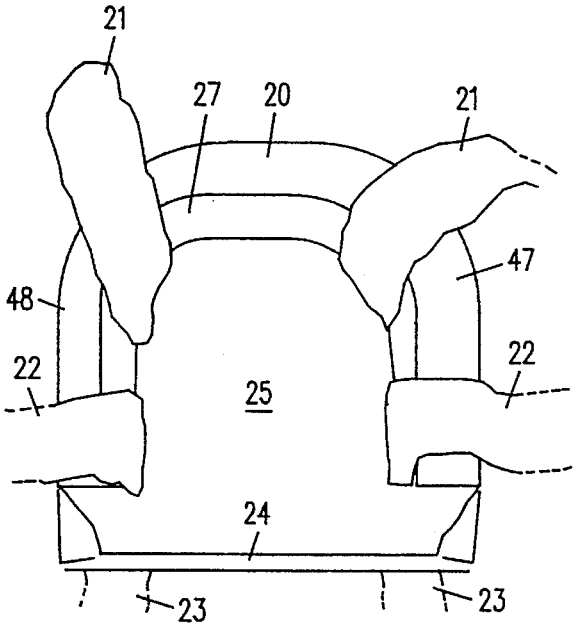
FIG. 3 is a rear perspective view of the exercise device of FIGS. 1.

Referring now to FIG. 3, front securing straps 21, 22 are fastened around the edges of platform element 20 adjacent footbed wall 27. Rear securing straps 23 may be attached at or near the rear edge 24 of platform element 20, substantially below upper surface 25 of platform element 20. This point of attachment enables normal flexion of the foot while ensuring that the exercise device rotationally follows the longitudinal flexion of the foot during use. By locating rear securing straps 23 at rear edge 24, shoe 30 is less likely to pull away from the exercise device of the present invention while in use.

It should be understood that upper surface 25 provides a substantially level surface, e.g., horizontal and thus substantially parallel to a level ground, for receiving the outsole (sole) of shoe 30. However, upper surface 25 may be curved to conform to a bottom of a shoe. Also, upper surface 25 may be contoured to the impression of a human foot. A level footbed reduces tilting forward by a user when using the exercise device of the present invention. As tilting forward is reduced, there is more resistance to rolling of the front of the foot. Thus, extra mass, in the form of resistance to rolling, is provided to the front of the foot. This provides for better training, especially for developing calf muscles.

Figure 4:
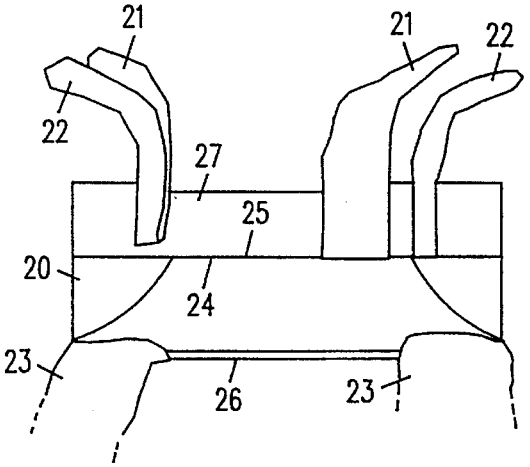
FIG. 4 is a rear elevation view of the exercise device of FIGS. 1–3.

FIG. 4 is a rear elevation view of the exercise device of the present invention. In this view, it will be apparent that rear securing straps 23 are fastened below upper surface 25 of platform element 20. In an embodiment, rear securing straps 23 are configured to lie substantially flat against the foot, footwear and lower leg when fastened. Front securing straps and rear securing straps may comprise padding for more comfort, especially when using the exercise device of the present invention with bare feet or low cut shoes.

Rear edge 24 of platform element 20 tapers backwards and upwards, forming a reverse taper. Tractive sole 26, is shown as a separately formed element, attached to the bottom of platform element 20. Tractive sole 26 may be cemented, fused, glued, molded or otherwise attached to platform element 20. Alternatively, tractive sole 26 may alternatively be integrally formed with platform dement 20 through molding, vacuum forming, machining or other processes well known in the art. Tractive sole may comprise ridges, a "waffle" pattern, dears, or other well known surfaces for footwear. In the preferred embodiment of the present invention, platform element 20 is molded to form platform element 20, footbed wall 27 and tractive sole 26.

Front securing straps 21, 22, as well as rear securing straps 23, are shown in their unfastened or separated configuration in FIGS. 3 and 4. Upper surface 25 of platform element 20 and footbed wall 27 combine to form the footbed for receiving the foot and footwear. Front securing straps 21, 22 are separately fastenable and adjustable for different footwear (or feet) or different sizes thereof (within a range of sizes) through the use of fastening means. In the preferred embodiment of the present invention, the exercise device may be used within plus or minus one and one-half sizes, inclusive, of the user's shoe size and still be adjusted to be sufficiently snug for use.

Figure 10:
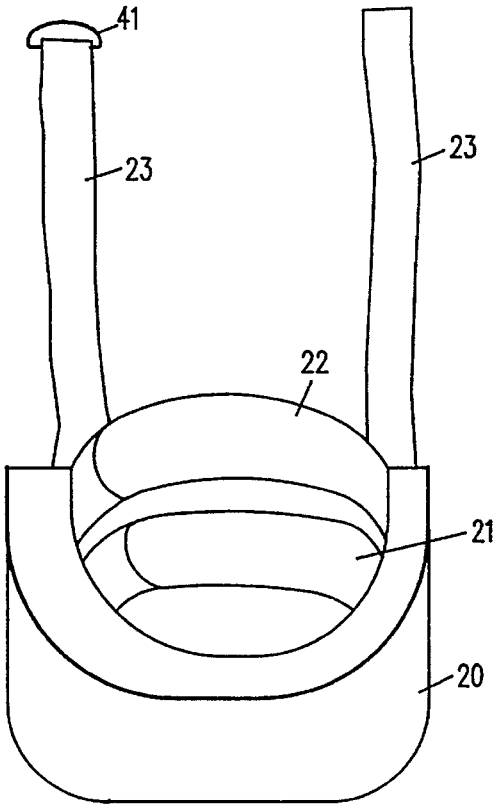
FIGS. 10–11 are alternate embodiments of the present invention as shown in FIGS. 1 and 3, respectively.

The preferred embodiment of the present invention comprises fastening means of hook and loop material. In the one embodiment, hook and loop tape is used. To adjust and fasten front securing straps 21, 22, the hook material portion of each strap is pressed together with its corresponding loop material portion on the same strap in a manner well known in the art. In an embodiment of the frontal sole exercise device of the present invention, fear securing straps 23 also comprise hook and loop material. In one embodiment, rear securing straps are made of hook and loop tape. Additionally, rear securing straps 23 may include at least one D-ring 41 (as shown in FIG. 10). Alternatively, buckles, ratchet fasteners, paired D-tings, snaps, separable rivets, laces or other means well known to those skilled in the art may be used as fastening means for either the forward or rear securing straps, if desired. In one embodiment, front securing straps 21, 22 and rear securing straps 23 are made of a polypropylene material and comprise hook and loop material.

Referring again to FIG. 3, a means for receiving a substantial forward portion of the foot is shown as an indented footbed, comprising footbed wall 27 and upper surface 25 of platform element 20 in combination. The footbed receives the foot, positioning it upon upper surface 25 of platform element 20 and prevents inadvertent forward egress of the foot therefrom. In an embodiment of the present invention, the footbed is formed by attaching footbed wall 27, made of polyethylene to the upper surface 25 of platform element 20 by means of hot glue. Alternatively, the footbed could be integrally formed with platform element 20 by means of machining, casting, vacuum forming or other process well known to those skilled in the art. It should be noted that outer portion 47 of wall 27 is thicker than inner portion 48. Outer portion refers to the wall extending along the outside of the foot or footwear. For example, in FIG. 2, a fight shoe 30 is shown. Right shoe 30 has outer portion 47 aligned with the outer portion 67 of the right shoe 30. The additional thickness is added for structural integrity and to resist twisting out by the foot while in use. Thus, the user may push off against outer portion 47. Having a relatively thick wall 27 allows for greater lateral and longitudinal stability. Additionally, it should be understood that platform element 20 and wall 27 can be integrally made together such as to alternatively form a recessed footbed disposed in upper surface 25.

Figure 5:
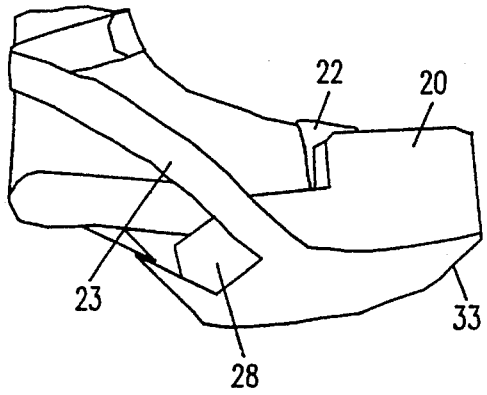
FIG. 5 is a bottom oblique perspective view of the exercise device of FIGS. 1–3.
Figure 6:
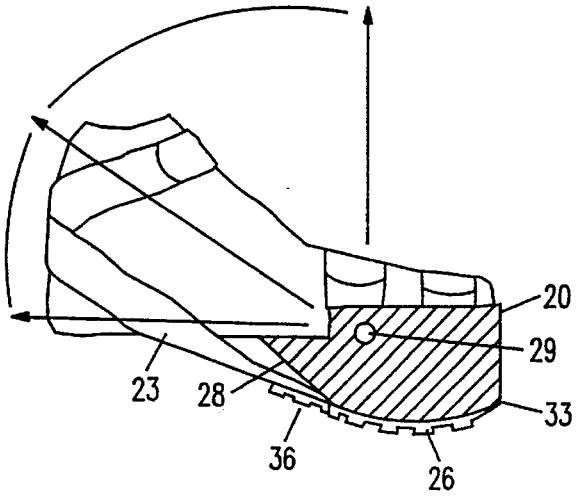
FIG. 6 is a cutaway side elevation view of a platform element of the exercise device shown in FIGS. 1–5, having an item of footwear attached, and showing the relationship between the point of flexion of the footwear and the platform element of the exercise device.

FIGS. 5 and 6 show rear bevel 28 and forward curve 33 of platform element 20. In addition, FIG. 6, which is a cutaway side elevation view, shows the tractive sole 26. FIG. 6 also shows the relationship between the point of flexion of the footwear and platform element 20 of the frontal sole exercise device of the present invention. Additionally, flap 36 of tractive sole 26 may be used with the present invention. Flap 36 provides mitigation of damage to rear securing straps 23.

Figure 7:
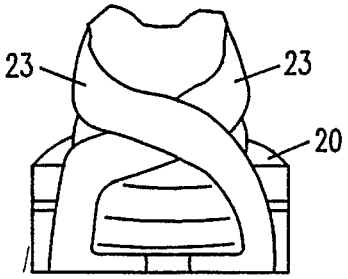
FIG. 7 is a rear elevation view of the exercise device of the present invention attached to an athletic shoe.

To use the exercise device of the present invention, front securing straps 21, 22 and rear securing straps 23 may be sufficiently loosened or unfastened as shown in FIG. 4, to permit insertion of a foot. The foot is inserted into the footbed and the forward straps tightened and fastened as shown in FIG. 5. Referring to FIG. 7, rear securing straps 23 are brought around the heel, and crossed over one another at the Achilles tendon area at the rear of the foot. Rear securing straps 23 are then wrapped around the ankle substantially above the ankle bone, e.g., the internal and external malleoli of the tibia and fibula, respectively, and fastened together by pressing the hook material with the loop material of rear securing straps 23 in a manner well known in the art.

Referring to FIG. 6, natural flex point 29 at the ball of the foot is shown. The attachment point of rear securing strap 23, originating as it does substantially below the plane of upper surface 25 of platform element 20 is likewise evident.

Figure 8:
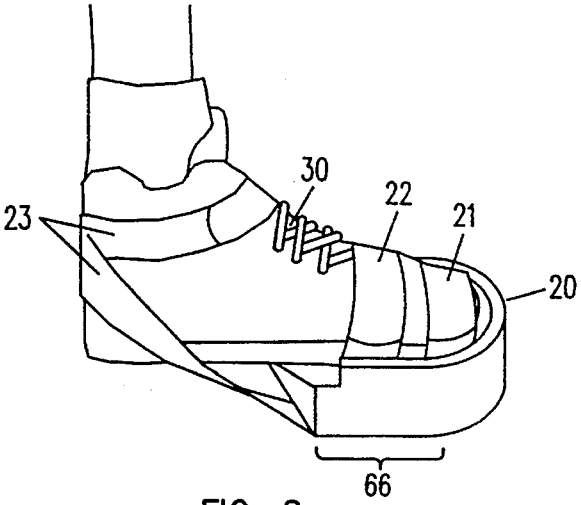
FIG. 8 is a fight perspective view of the exercise device attached to an athletic shoe.
Figure 9:
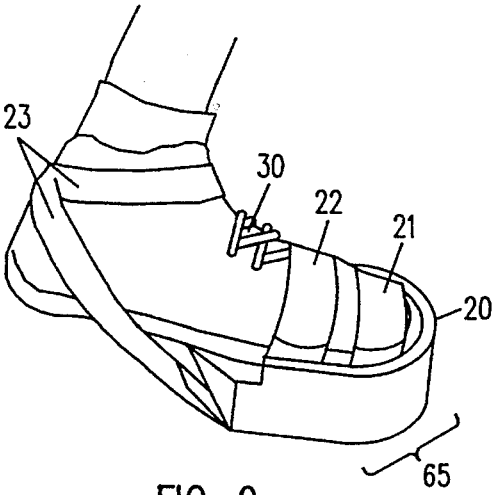
FIG. 9 is a fight perspective view of the exercise device attached to an athletic shoe while in use, toward the end of a stride.

After donning the exercise device of the present invention (usually, but not necessarily in pairs, one per foot) in the manner previously described, various exercises or training regimens are conducted to strengthen and condition the muscles of the lower body. FIG. 8 is a fight perspective view of the exercise device attached to an athletic shoe. FIG. 9 is a right perspective view of the exercise device attached to an athletic shoe illustrating it in use, near the end of a stride.

As illustrated in FIGS. 8 and 9, the fact that rear securing straps 23 extend from below upper surface 25 of platform element 20 to the ankle minimizes the tendency of the foot to pull away from the platform element 20 during use, as the foot flexes longitudinally about its natural flex point 29 (shown in FIG. 6). Also, ground plane of contact 66 is to be distinguished in the preferred embodiment from the ground arcuate contact 65. Rear securing straps 23 may be attached to platform element 20 near ground plane of contact 66, or further near both ground plane of contact 66 and arcuate contact 65.

As shown in FIGS. 10–11, from securing straps 21, 22 may each comprise at least one D-ting 41, and rear securing straps 23 may comprise at least one D-ring 41. Also, as is known, more than one ring may be used to tighten and maintain attachment of a shoe to the present invention. Additionally, platform element 20 may comprise inward contour 51 for narrowing. In which case, rear edge 24 is narrower than opposing bottom edge 53. Additionally, a bladder 49, e.g., an air bladder may be used with the present invention. Also, a pump 39 may be coupled to bladder 49 for increasing the pressure in the bladder.

Figure 12:
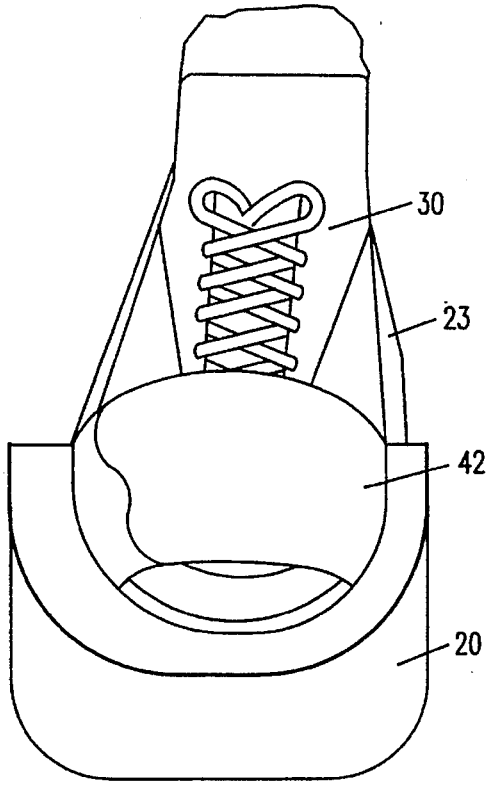
FIG. 12 is an alternate embodiment of the present invention as shown in FIG. 2.

As shown in FIG. 12, a single front securing strap 42 may be used. Front securing strap 42 may comprise a hook and loop type material, with or without a D-ting 41. Alternatively, front securing strap 42 may comprise other well known means for fastening.

Figure 13:
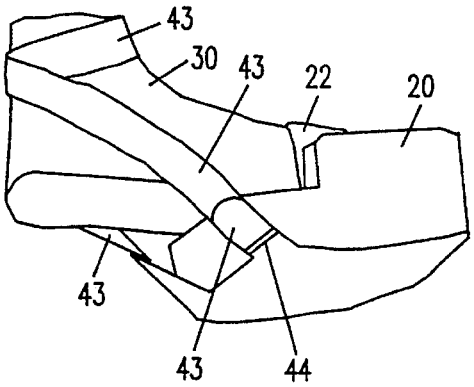
FIGS. 13–14 are alternate embodiments of the present invention as shown in FIGS. 5 and 8, respectively.
Figure 14:
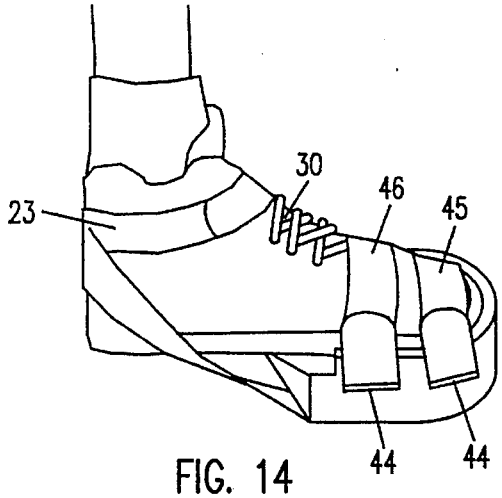

As shown in FIGS. 13–14, platform element 20 may include one or more openings 44. An opening 44 allows a strap to be inserted into one end and out another end of opening 44. In this manner front securing straps 45, 46 and rear securing strap 43 may each be made of a single continuous strip. These straps can comprise hook and loop type material or other fastening means known in the art.

Figure 15:
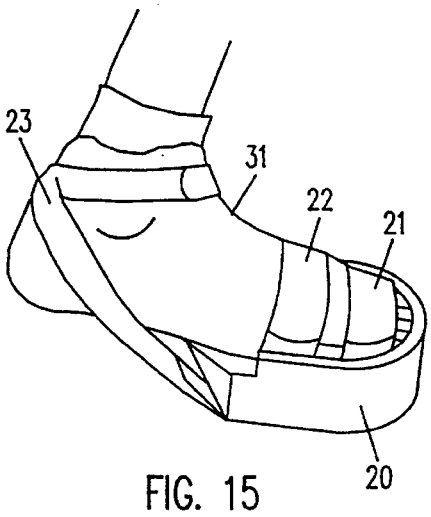
FIG. 15 shows use of the present invention with a bare foot.

As shown in FIG. 15, a bare foot 31 may be used with the present invention. Some athletes prefer to train in bare feet. Thus, the present invention teaches that bare feet may be used while practicing the art as taught by the present invention.

PREFERRED EMBODIMENT

The present invention's preferred embodiment is described in this section. As will be evident from this description, the preferred embodiment represents an improvement over the embodiments previously described. However, it should be understood that many of the modifications to the basic design described above may be practiced with the preferred embodiment of the present invention.

Figure 16:
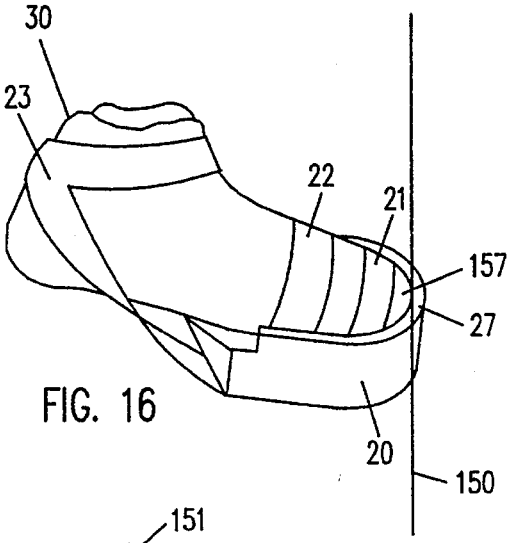
FIG. 16 is a perspective view of an embodiment of the present invention attached to a shoe, toward the beginning of a stride.

FIG. 16 is a right perspective view of a previously described embodiment of the present invention. To demonstrate the improvement of the preferred embodiment over the embodiment of FIG. 16, reference line 150 and shoe tip 157 are indicated. When a user strides, for example, shoe 30 may move with respect to platform element 20. The location of tip 157 generally is different at differing points of the user's stride. In FIG. 16. the beginning of a forward stride of a user is shown with shoe tip 157 forward toward footbed wall 27.

Figure 17:
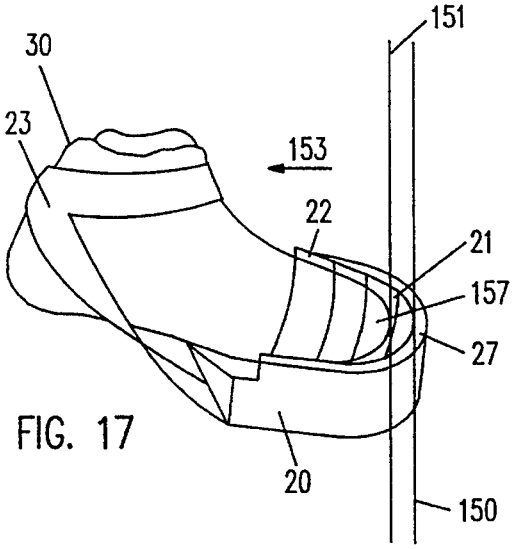
FIG. 17 is the perspective view of FIG. 16 later in the stride.

FIG. 17 is a fight perspective view of FIG. 16 at a later point in the forward stride. Reference line 151 has been added to aid indication of movement of shoe tip 157. As shoe 30 is brought in backward direction 153 for the forward stride, shoe tip 157 may also move backward. This displacement of shoe tip 157 is indicated by reference lines 150 and 151. Displacement is more likely during vigorous exercise.

Figure 18:
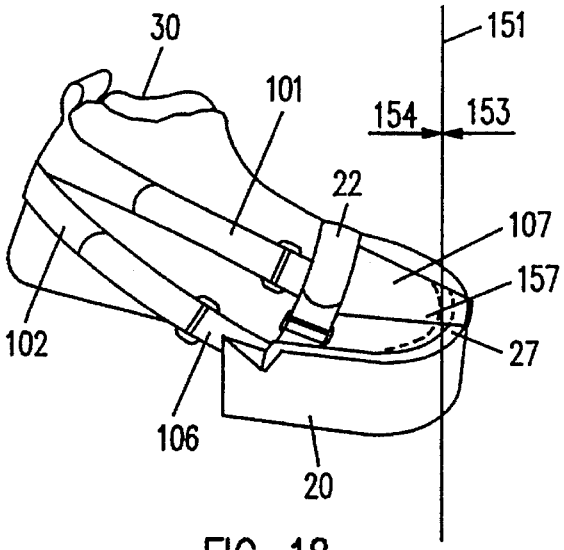
FIG. 18 is a perspective view of the preferred embodiment of the present invention later in the stride, as in FIG. 17.

To significantly limit this displacement, the preferred embodiment of the present invention provides longitudinal upper strap 101, longitudinal upper anchor strap 107, radial lower strap 102 and radial lower anchor straps 106 in place of rear securing straps 23, as shown in FIG. 18. FIG. 18 is a perspective view of the preferred embodiment of the present invention at a later point in the stride, as in FIG. 17. As is shown with reference line 150, shoe tip 157 does not move as it did in FIG. 17. Rather shoe tip 157 is held against footbed wall 27 in direction 154. This is principally due to straps 101 and 107, which are used in combination to prevent rearward shifting.

Figure 19:
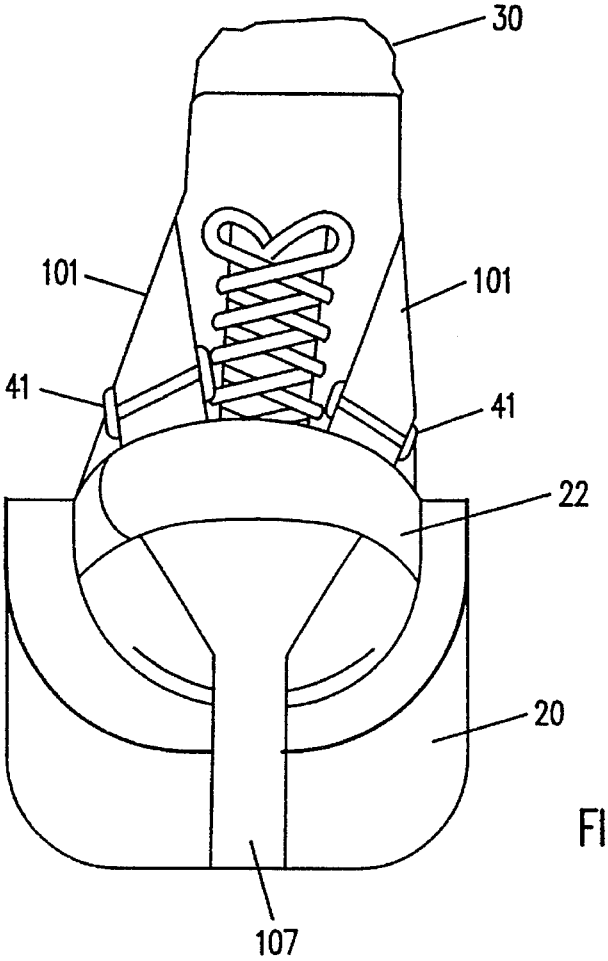
FIG. 19 is a front perspective view of FIG. 18.

Referring to FIGS. 18–21, front securing strap 21 is omitted and functionally replaced with strap 107 (the "Y" shaped strap). Strap 107 may be further held to shoe 30 with front securing strap 22 on top, as shown in FIG. 19. This allows shoe 30 to be more firmly held in the present invention.

Figure 21:
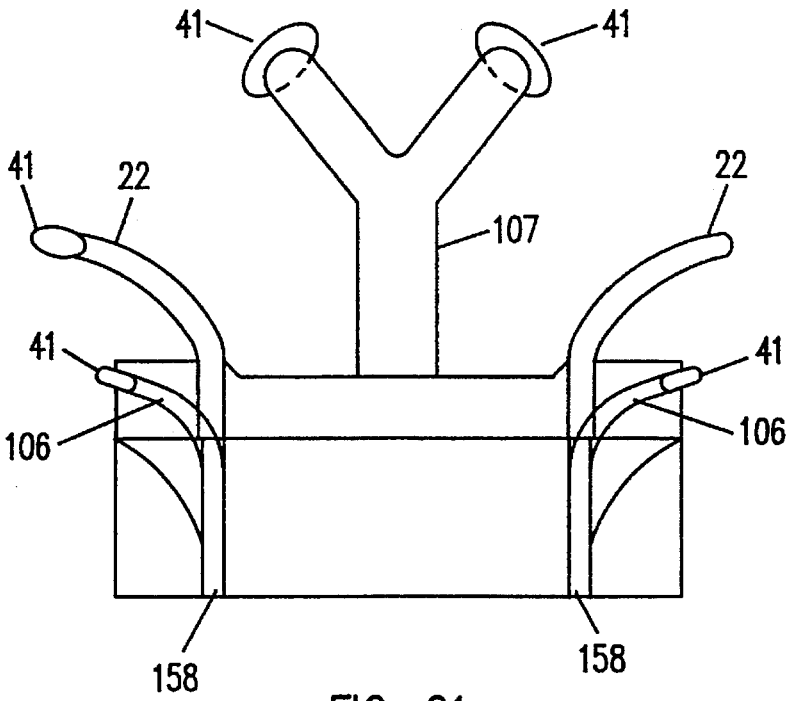
FIG. 21 is a rear elevation view of the preferred embodiment of the present invention.

Straps 106, located on either side platform element 20 as shown in FIG. 21, are substantially parallel to the fight and left sides of shoe 30. In the preferred embodiment of the present invention, slots 158 are provided in platform element 20 for securing straps 106 therein. This allows straps 106 to lay flush against the sides of shoe 30, and eliminates the twisting associated with rear straps 23. Moreover, straps 101, 102, 106 and 107 are simpler to arrange than rear securing straps 23.

Figure 20:
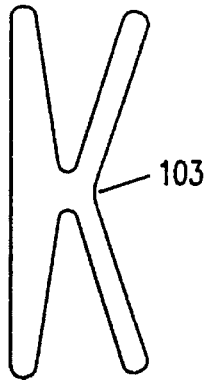
FIG. 20 is a strap for use with the preferred embodiment of the present invention.
Figure 22:
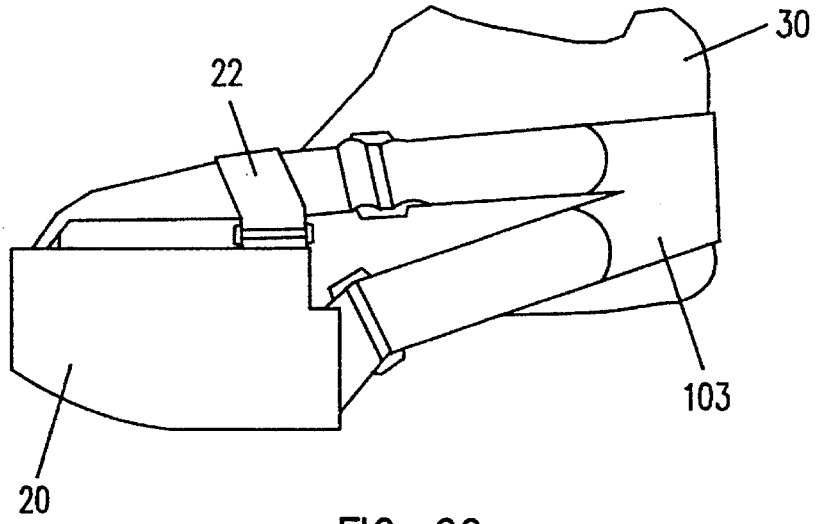
FIG. 22 is a left elevation view of the preferred embodiment of the present invention.

Straps 101 and 102 may be two individual straps, or, alternatively, may comprise one strap 103 (the "K" shaped strap), as shown in FIG. 20. Strap 103 is more effective in holding the functional equivalent of straps 106 and 102 against the back of shoe 30. Also, strap 103 is designed to conform around the back of shoe 30. Strap 103 threads through the pre-existing D-rings 41, and thus is intuitively simpler to attach than rear securing straps 23. FIG. 22 shows a left elevation view of the preferred embodiment of the present invention with strap 103.

The present invention has been particularly shown and described with respect to certain preferred embodiments of features thereof. However, it should be readily apparent to those of ordinary skill in the art that various changes and modifications in form and detail may be made without departing from the spirit and scope of the invention as set forth in the appended claims. The invention illustratively disclosed herein may be practiced without any element which is not specifically disclosed herein.

What is claimed is:

1. A frontal sole exercise device for removably coupling to footwear, the footwear having an outsole, a heel, a vamp, a backstay, and a tip, the device comprising:

a platform having a semi-circular-like shaped wall, the wall defining a footbed for receiving the outsole of the footwear, the platform of sufficient thickness for elevating the heel off the ground;

a Y-shaped strap attached to the platform, one end of the Y-shaped strap attached to the platform for a frontal coincidence with the tip of the footwear and a front tip of the platform, ends opposite the one end of the Y-shaped strap being positioned on opposite sides of the footwear with the one end of the Y-shaped strap being directly adjacent to an exterior surface of the wall;

two lower anchor straps disposed apart from one another being attached to the platform, the two lower anchor straps being positioned on opposite sides of the footwear;

a K-shaped strap, a first two ends of the K-shaped strap for attachment to the ends opposite the one end of Y-shaped strap, a second two ends of the K-shaped strap for attachment to respective ends of the two lower anchor straps, the K-shaped strap being positioned around the back stay and along opposite sides of the footwear;

two securing straps attached on opposite sides of the footbed and adjacent to the wall, the two securing straps being positioned on opposite sides and on top of the footwear; and a plurality of means for attaching the first two ends of the K-shaped strap to the ends opposite the one end of the Y-shaped strap, for attaching the second two ends of the K-shaped strap for attachment to the respective ends of the two lower anchor straps, and for attaching ends of the securing straps to one another;

the Y-shaped strap attached to the platform and to the K-shaped strap for limiting displacement of the tip from the wall owing to rearward movement of the footwear.

2. The device of claim 1 wherein the plurality of means for attaching comprises buckles.

3. The device of claim 1 wherein the plurality of means for attaching allows for adjustment of the device for accommodating footwear of varying dimensions.

4. A frontal sole exercise device for removably coupling to footwear, the footwear having an outsole, a vamp, a heel, a backstay, and a tip, the device comprising:

a platform having a semi-circular-like shaped wall, the wall defining the footbed for receiving the outsole of the footwear, the platform of sufficient thickness for elevating the heel;

a Y-shaped strap attached to the platform, one end of the Y-shaped strap attached to the platform for a frontal coincidence with the tip of the footwear and a front tip of the platform, ends opposite the one end of the Y-shaped strap being positioned on opposite sides of the footwear with the one end of the Y-shaped strap being directly adjacent to an exterior surface of the wall;

two lower anchor straps disposed apart from one another being attached to the platform, the two lower anchor straps being positioned on opposite sides of the footwear;

an upper strap having two ends for attachment to the ends opposite the one end of the Y-shaped strap, the upper strap being positioned around the backstay and along opposite sides of the footwear;

a lower strap having two ends for attachment to respective ends of the two lower anchor straps, the lower strap being positioned around the backstay and along opposite sides of the footwear;

two securing straps attached on opposite sides of the footbed and adjacent to the wall, the two securing straps being positioned on opposite sides and on top of the footwear; and a plurality of means for attaching the two ends of the upper strap to the ends opposite the one end of the Y-shaped strap, for attaching the two ends of the lower strap to the respective ends of the two lower anchor straps, and for attaching ends of the securing straps to one another;

the Y-shaped strap attached to the platform and to the upper strap for limiting displacement of the tip from the wall owing to rearward movement of the footwear.

5. The device of claim 4 wherein the plurality of means for attaching comprises buckles.

6. The device of claim 4 wherein the plurality of means for attaching allows for adjustment of the device for accommodating footwear of varying dimensions.

* * * * *